US005890478A

United States Patent [19]

Dunmore

[11] Patent Number: 5,890,478

[45] Date of Patent: Apr. 6, 1999

[54] BOW SUPPORT DEVICE FOR ARCHERS

[76] Inventor: James E. Dunmore, 864 - 6th Ave., North Clinton, Iowa 52732

[21] Appl. No.: 842,746

[22] Filed: Apr. 16, 1997

[51] Int. Cl.[6] ..... F41B 5/14

[52] U.S. Cl. ..... 124/86; 224/257; 224/269; 224/916

[58] Field of Search ..... 124/1, 23.1, 86; 224/257, 269, 916

[56] References Cited

U.S. PATENT DOCUMENTS

| | | | |
|---|---|---|---|
| 4,684,047 | 8/1987 | Burgwin | 224/916 X |
| 5,038,987 | 8/1991 | Huddleston | 224/916 X |
| 5,065,732 | 11/1991 | Smith | 124/23.1 X |
| 5,239,976 | 8/1993 | Specht | 124/23.1 X |

OTHER PUBLICATIONS

Saunders 1990 Catalog, Kwik Lok Arrow Holder, p. 11.
Bass Pro Shops, 1995 Archery Catalog, p. 39.
Cabela's 1995 Archery Shop, Bow Stabilizers and Slings, p. 46.
Gander Mountain Archery 1995, pp. 56, 57.

*Primary Examiner*—John A. Ricci
*Attorney, Agent, or Firm*—Henderson & Strum

[57] ABSTRACT

A bow support device comprising a spring-loaded alligator type clip for attachment to the nock of a loaded arrow which is suspended from an archer's person, allowing the archer to release his grasp on the bow for extended periods of time while stalking or awaiting the approach of wild game. A first embodiment utilizes an alligator type clip for securement of the device to the archer's clothing, as to the flap of a jacket pocket, while a second embodiment suspends the nock attaching clip from the archer's neck.

3 Claims, 3 Drawing Sheets

BOW SUPPORT DEVICE FOR ARCHERS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to archery, and more particularly to a support device which clips to the nock of a loaded arrow, allowing a hunter to release his grip on the bow while awaiting the approach of game.

2. Description of the Related Art

The archery art includes several devices which provide an archer some relief from the fatigue of continually gripping his bow while hunting or awaiting the approach of wild game. Such devices include: (1) holsters which hang from the archer's belt and which receive the lower tip of the bow, thus supporting the weight of the bow and arrow; (2) racks which attach to the archer's tree stand or the like and hold a loaded bow; and (3) slings which attach to the bow and pass over the archer's shoulder, thus supporting the weight of the bow. While all of the aforementioned prior art constructions are adequate for the basic purpose and function for which they have been specifically designed, none allow the archer to completely release his grasp of the bow and yet maintain the bow at a ready position requiring minimal movement to regrasp it when wild game should appear.

BRIEF SUMMARY OF THE INVENTION

Briefly stated, the bow support device that forms the basis of the present invention comprises a spring-loaded alligator type clip for attachment to the nock of a loaded arrow which is suspended from an archer's person, allowing the archer to release his grasp on the bow for extended periods of time while stalking or awaiting the approach of wild game. A first embodiment utilizes an alligator type clip for securement of the device to the archer's clothing, as for instance to the flap of a jacket pocket, while a second embodiment suspends the nock attaching clip from around the archer's neck.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
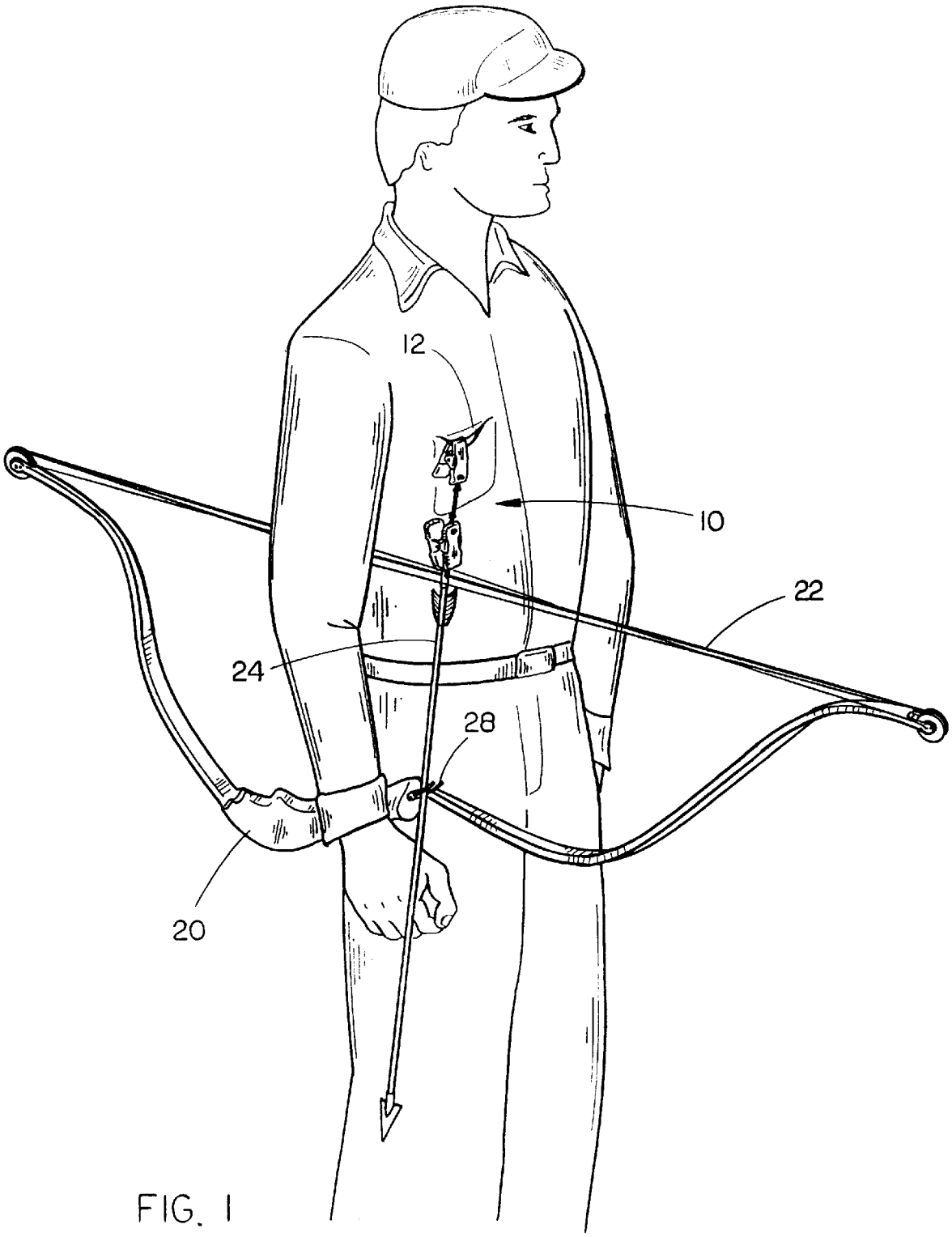
FIG. 1 is a perspective view of a first embodiment of the invention in use.

Referring now to the drawings, wherein like reference numerals designate identical or corresponding parts throughout the several views, FIG. 1 depicts an archer utilizing the present invention, depicted generally at 10. As clearly seen, the invention 10 allows the archer to release his grip on the loaded bow 20 while it hangs from his jacket pocket flap 12.

Figure 2:
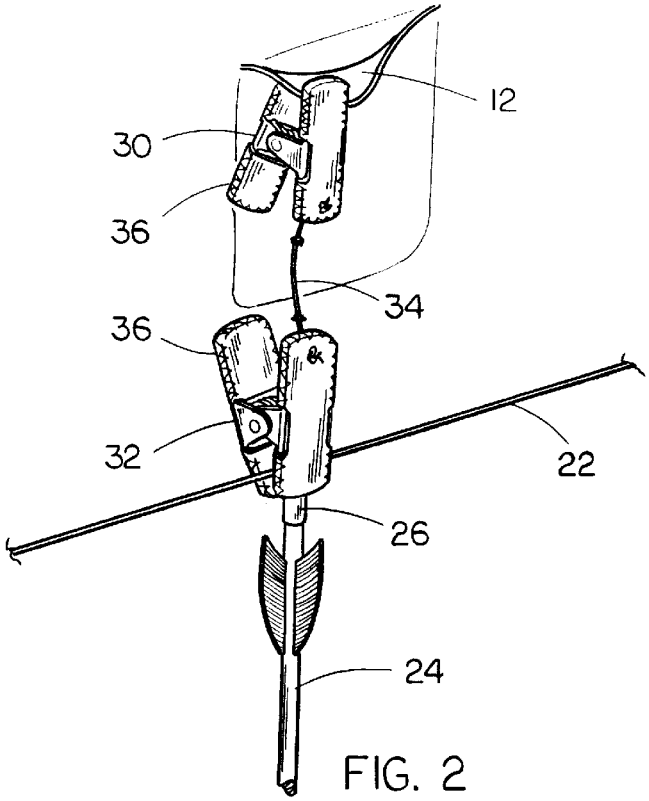
FIG. 2 is a close-up perspective view of the first embodiment.
Figure 3:
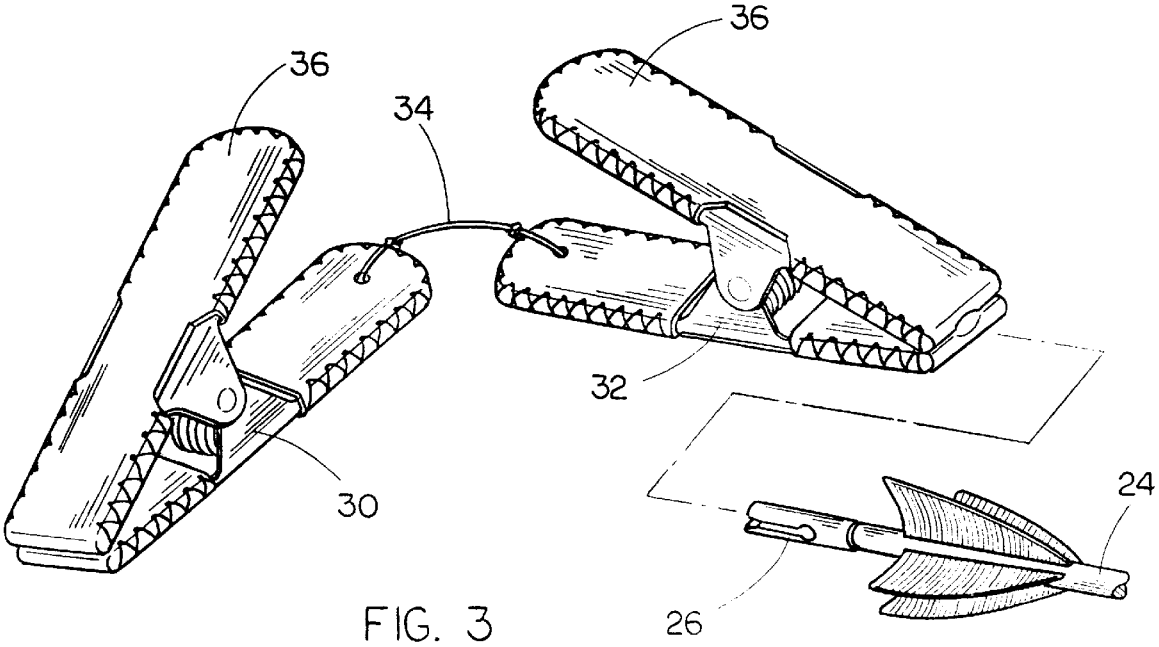
FIG. 3 is a perspective view of the first embodiment of the invention and the nock of an arrow to be secured within the alligator type clip.

Referring also to FIG. 2 and FIG. 3, the invention 10 is seen to comprise a first spring-loaded alligator type clip 30, a second spring-loaded alligator type nock clip 32, and a strap 34, fabricated from leather or other similar durable, flexible material, which connects the two clips 30, 32 together. In a preferred embodiment, the two clips 30, 32 are substantially enclosed within a covering 36, also preferably fabricated from leather. The first clip 30 attaches to the archer's person, as for instance to a jacket pocket flap 12 as shown in FIG. 1 and FIG. 2. The second clip 32 is secured upon the nock 26 of an arrow 24 after the nock 26 has been affixed upon the bow string 22. The arrow 24 may be further releasably attached to the bow by an arrow holder 28 (FIG. 1).

Figure 4:
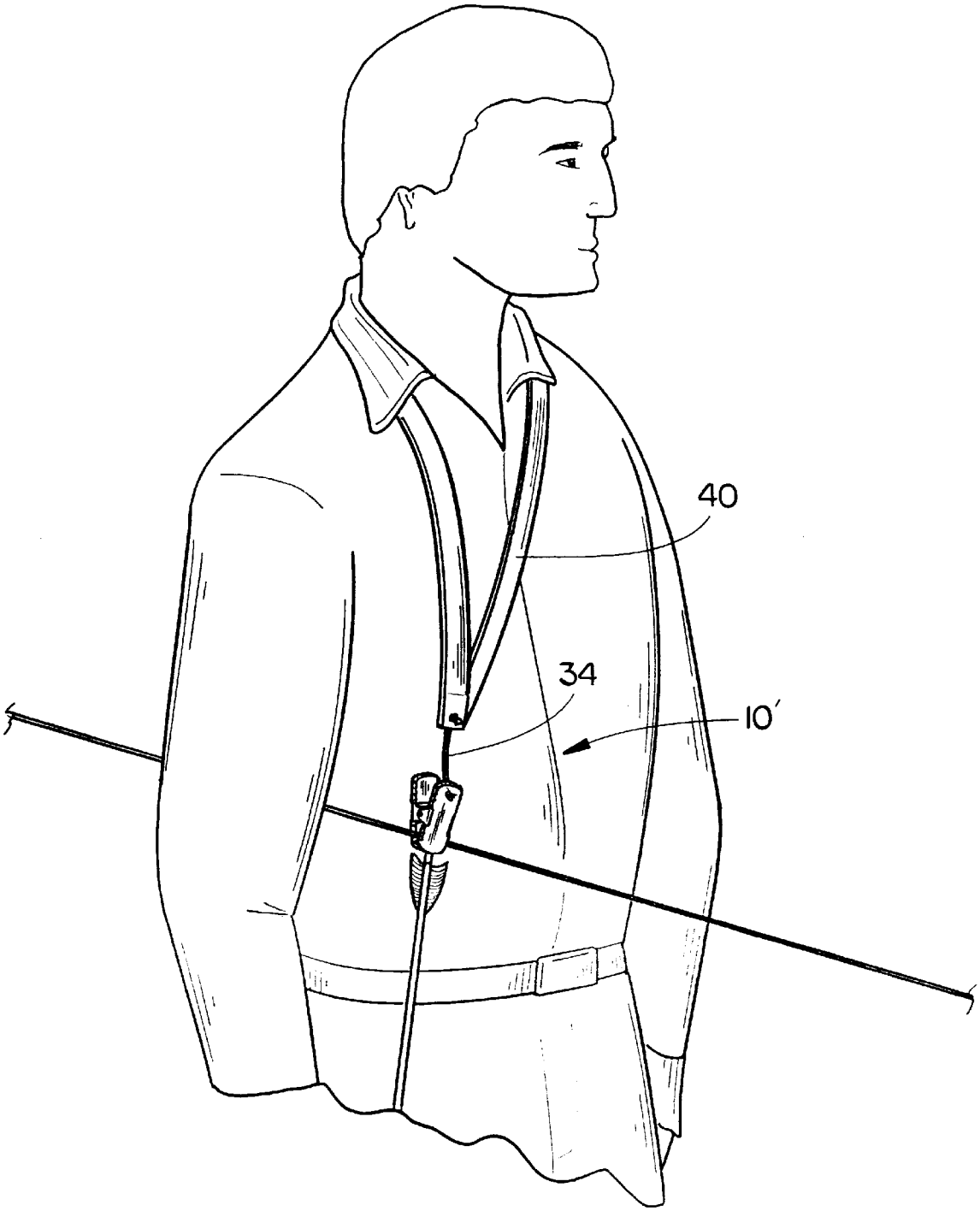
FIG. 4 is a perspective view of a second embodiment of the invention in use.

A second embodiment of the invention 10' is depicted in FIG. 4, wherein the first clip 30 has been replaced with a flexible loop 40, preferably fabricated from the same material as the strap 34, which passes around the archer's neck. The loop 40 may be attached directly to the nock clip 32, or may attach to an intervening strap 34 as depicted.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A bow and arrow support device for archers, comprising:

(a) spring loaded jaw means for engaging the arrow nock of the arrow loaded upon the bow;

(b) means for operative engagement upon the archer's person; and (c) a generally flexible strap for connecting the jaw means to the operative engagement means to releasably suspend the loaded bow from a portion of the archer's person.

2. A bow and arrow support device for archers, comprising:

(a) spring loaded jaw means for engaging the arrow nock of the arrow loaded upon the bow;

(b) second releasable fastening means for operative engagement with a portion of the archer's torso; and (c) a generally flaccid strap for connecting the jaw means to the second releasable fastening means to releasably suspend the bow and arrow from a portion of the archer's torso.

3. A hands free bow and arrow support device for archers comprising:

(a) a strap member having a bottom end and a top end;

(b) a fastening member having spring loaded jaws disposed on the bottom end of the strap member and adapted to releasably engage an arrow nock engaged with a portion of the bow string; and (c) a suspension member disposed on the top end of the strap member for suspending the bow and arrow in a hands free fashion from a portion of the archer's torso.

* * * * *